US008650678B2

(12) United States Patent
Thorne et al.

(10) Patent No.: US 8,650,678 B2
(45) Date of Patent: Feb. 18, 2014

(54) CORNER LATCHING PLAY YARD

(75) Inventors: Henry F. Thorne, West View, PA (US); Robert D. Daley, Pittsburgh, PA (US); Frederick Karl Hopke, Glenshaw, PA (US); Elijah M. Wiegmann, Pittsburgh, PA (US); Jessica A. Bailey, Pittsburgh, PA (US); Jared A. Rosenthal, Pittsburgh, PA (US)

(73) Assignee: Thorley Industries LLC, Pittsburgh, PA (US)

( * ) Notice: Subject to any disclaimer, the term of this patent is extended or adjusted under 35 U.S.C. 154(b) by 0 days.

(21) Appl. No.: 13/432,165

(22) Filed: Mar. 28, 2012

(65) Prior Publication Data

US 2012/0248394 A1 Oct. 4, 2012

Related U.S. Application Data

(60) Provisional application No. 61/468,168, filed on Mar. 28, 2011.

(51) Int. Cl.
*A47D 7/00* (2006.01)

(52) U.S. Cl.
USPC ..... 5/99.1; 5/93.1; 5/98.1

(58) Field of Classification Search
USPC ..... 5/99.1, 93.1, 98.1, 98.3
See application file for complete search history.

(56) References Cited

U.S. PATENT DOCUMENTS 1,812,699 A 6/1931 Hursh
1,975,332 A 10/1934 Rehkopf
2,054,755 A 9/1936 Kovats
2,380,812 A 7/1945 Webb
2,670,477 A 3/1954 Pond
2,825,071 A 3/1958 Landry et al.
2,908,021 A 10/1959 Fulton
2,922,169 A 1/1960 Werner
3,092,847 A 6/1963 De Puy
3,119,124 A 1/1964 Krauss
3,187,352 A 6/1965 Gottlieb
3,206,773 A 9/1965 Sarasin
3,237,575 A 3/1966 Larson
3,266,445 A 8/1966 Larson
3,309,718 A 3/1967 Sarasin
3,430,273 A 3/1969 Stillwaugh
3,464,373 A 9/1969 Larson
3,474,472 A 10/1969 Hamilton, II
3,789,439 A 2/1974 Berg et al.
3,848,278 A 11/1974 Propst
4,069,524 A 1/1978 Carlo
4,070,716 A 1/1978 Satt et al.
4,357,735 A 11/1982 Saint et al.

(Continued)

FOREIGN PATENT DOCUMENTS

EP 1430816 A1 6/2004

*Primary Examiner* — Fredrick Conley
(74) *Attorney, Agent, or Firm* — The Webb Law Firm

(57) ABSTRACT

A foldable structure includes: an upper assembly forming an upper portion of the structure; a base assembly forming a lower portion of the structure; a centrally-located hub assembly operatively connected to the base assembly; and a post extending from each corner of the upper assembly to a corner of the base assembly. The upper assembly includes a plurality of arm assemblies. At least one latching mechanism is provided at each corner of the upper assembly extending from an upper portion of at least one of the posts to a portion of at least one of the arm assemblies.

19 Claims, 18 Drawing Sheets

(56) References Cited

U.S. PATENT DOCUMENTS

| | | | |
|---|---|---|---|
| 4,437,414 | A | 3/1984 | Brescia et al. |
| 4,448,380 | A | 5/1984 | Huber-Krattiger |
| 4,455,697 | A | 6/1984 | Rovida |
| 4,710,049 | A | 12/1987 | Chang |
| 4,811,437 | A | 3/1989 | Dillner et al. |
| 4,819,285 | A | 4/1989 | Fetters |
| 4,837,875 | A | 6/1989 | Shamie et al. |
| 4,985,948 | A | 1/1991 | Mariol |
| 5,025,517 | A | 6/1991 | Johnson |
| 5,193,234 | A | 3/1993 | Joaquin |
| 5,197,154 | A | 3/1993 | Shamie |
| 5,239,714 | A | 8/1993 | Huang |
| 5,241,716 | A | 9/1993 | Kohus |
| 5,243,718 | A | 9/1993 | Shamie |
| 5,279,006 | A | 1/1994 | Teng |
| 5,293,656 | A | 3/1994 | Chan |
| 5,353,451 | A | 10/1994 | Hsiung |
| 5,358,220 | A | 10/1994 | Yu-Kuang |
| 5,363,521 | A | 11/1994 | Garland et al. |
| 5,367,725 | A | 11/1994 | Tsai |
| 5,381,570 | A | 1/1995 | Cheng |
| D359,869 | S | 7/1995 | Oren |
| 5,504,951 | A | 4/1996 | Yeh |
| 5,513,399 | A | 5/1996 | Weng |
| 5,530,977 | A | 7/1996 | Wang |
| 5,615,427 | A | 4/1997 | Huang |
| 5,809,592 | A | 9/1998 | McAllister |
| 5,867,851 | A | 2/1999 | Mariol et al. |
| 5,911,653 | A | 6/1999 | Cheng |
| 6,125,483 | A | 10/2000 | Stroud et al. |
| 6,254,177 | B1 | 7/2001 | Tseng |
| 6,256,814 | B1 | 7/2001 | Drobinski |
| 6,317,907 | B1 | 11/2001 | Wang |
| 6,336,234 | B1 | 1/2002 | Kuo |
| 6,343,390 | B1 | 2/2002 | Yang et al. |
| 6,357,462 | B1 | 3/2002 | Laosunthara et al. |
| 6,421,850 | B1 | 7/2002 | Welsh, Jr. |
| 6,473,919 | B1 | 11/2002 | Wang |
| 6,510,568 | B1 | 1/2003 | Drobinski et al. |
| 6,588,033 | B1 | 7/2003 | Welsh, Jr. et al. |
| 6,634,038 | B2 | 10/2003 | Hsia |
| 6,684,420 | B2 | 2/2004 | Koenig et al. |
| 6,851,135 | B1 | 2/2005 | Chen |
| 6,865,756 | B2 | 3/2005 | Clapper et al. |
| 6,907,626 | B1 | 6/2005 | Welsh, Jr. et al. |
| 7,043,779 | B2 | 5/2006 | Mendenhall et al. |
| 7,069,605 | B2 | 7/2006 | Harvey, III |
| 7,343,634 | B2 | 3/2008 | Song |
| 7,401,367 | B2 | 7/2008 | Gehr et al. |
| 7,418,746 | B2 | 9/2008 | Gehr et al. |
| 7,458,115 | B2 | 12/2008 | Chen et al. |
| 7,464,420 | B2 | 12/2008 | Chen et al. |
| 7,568,242 | B2 | 8/2009 | Troutman |
| 7,600,276 | B2 | 10/2009 | Chen et al. |
| 7,661,156 | B2 | 2/2010 | Thorne et al. |
| 7,836,530 | B2 | 11/2010 | Thorne et al. |
| 8,060,959 | B2 | 11/2011 | Thorne et al. |
| 2003/0061657 | A1 | 4/2003 | Longenecker et al. |
| 2004/0045085 | A1 | 3/2004 | Yang |
| 2006/0021137 | A1 | 2/2006 | Waldman et al. |
| 2006/0037137 | A1 | 2/2006 | Song |
| 2006/0174406 | A1 | 8/2006 | Yang |
| 2006/0185082 | A1 | 8/2006 | Casati Troutman |
| 2006/0211138 | A1 | 9/2006 | Jackowski et al. |
| 2006/0225204 | A1 | 10/2006 | Bretschger et al. |
| 2006/0225208 | A1 | 10/2006 | Chen |
| 2007/0017025 | A1* | 1/2007 | Myer ..... 5/99.1 |
| 2007/0157379 | A1 | 7/2007 | Lin |
| 2007/0163041 | A1 | 7/2007 | Cheng et al. |
| 2007/0277308 | A1 | 12/2007 | Chen et al. |
| 2008/0034498 | A1 | 2/2008 | Chen et al. |
| 2008/0189854 | A1* | 8/2008 | Thorne et al. ..... 5/99.1 |
| 2008/0209631 | A1 | 9/2008 | Thomas et al. |
| 2008/0289103 | A1 | 11/2008 | Gehr et al. |
| 2009/0019637 | A1 | 1/2009 | Gehr et al. |
| 2009/0172879 | A1 | 7/2009 | Hsu |
| 2011/0031457 | A1 | 2/2011 | Thorne et al. |

* cited by examiner

CORNER LATCHING PLAY YARD

CROSS REFERENCE TO RELATED APPLICATIONS

This application is based on U.S. Provisional Patent Application No. 61/468,168, filed Mar. 28, 2011, on which priority of this patent application is based and which is hereby incorporated by reference in its entirety.

BACKGROUND OF THE INVENTION

1. Field of the Invention

The present invention relates generally to a foldable child enclosure, such as a play yard, playpen, or crib apparatus, and, more particularly, to a child enclosure apparatus that is quick and easy to open for use and to fold for transport and/or storage.

2. Description of Related Art

Foldable play yards, playpens, and crib devices are well-known, as perhaps best exemplified by U.S. Pat. No. 4,811,437 for a "Foldable Playyard" to Dillner et al. The foldable device disclosed therein is light in weight and, when collapsed, a fairly convenient compact package. One major problem with such devices, however, is that they are difficult to handle because they are cumbersome to open and unwieldy to fold with clumsy operating mechanisms. Usually there is a need to pull up on a central lower mechanism and a need to unlatch upper rails also. Another device is shown in an application, U.S. Patent Application Publication No. 2007/0017025, for a "Folding Play Yard" by Myer. There is a purported disclosure of a release mechanism that causes release means such as a cable to unlatch upper side members so that the play yard may go from a deployed to a folded condition. However, there is no disclosure concerning the movement of the play yard from the folded condition to a deployed condition. The release means play no part in such a movement. Furthermore, the lower structure of the disclosed play yard includes diagonal braces, as well as side members, so that the play yard is complicated and heavy.

A more easily operated device that opens and folds smoothly is desirable, especially for those users doing so while attention is being directed to young children. An efficient, low weight, and robust structure is also desirable. In addition, a further need exists for such a play yard that includes a latching mechanism for locking the play yard in the open position that is robust and also easily hidden from view.

SUMMARY OF THE INVENTION

Accordingly, an object of the present invention is to provide a foldable structure, such as an enclosure for a child, that can be easily operated to open and fold in a fast and smooth manner with little effort on the part of the user. More specifically, the foldable structure of the present invention advantageously provides a one-step process to open or fold the enclosure, where pushing down on or lowering of a centrally-located hub assembly opens the structure, and pulling up on or raising the hub assembly folds the structure.

More specifically, the foldable structure of the present invention achieves this goal by operating in a three-phase manner through a single interface. In the first phase, the user pushes down on the centrally-located hub assembly which causes legs of a base assembly to spread apart. In the next phase, the legs of the base assembly maintain the side posts of the structure at a substantially vertical position. In the final phase, latches provided in the upper corners of the structure lock the enclosure in the unfolded or open state.

According to one embodiment of the invention, the foldable structure includes: an upper assembly forming an upper portion of the structure; a base assembly forming a lower portion of the structure; a centrally-located hub assembly operatively connected to the base assembly; and a post extending from each corner of the upper assembly to a corner of the base assembly, thereby forming the structure. The upper assembly includes a plurality of arm assemblies. At least one latching mechanism is provided at each corner of the upper assembly extending from an upper portion of at least one of the posts to a portion of at least one of the arm assemblies. Movement of the hub assembly towards a surface upon which the foldable structure is positioned causes the foldable structure to move from a folded position to an opened position, and movement of the hub assembly away from the surface causes the foldable structure to move from the open position to the folded position.

The hub assembly may be operatively connected to the at least one latching mechanism by an operating structure. Movement of the hub assembly towards a surface upon which the foldable structure is positioned may cause the operating structure to force the at least one latching mechanism into a locked position, and movement of the hub assembly away from the surface causes the operating structure to force the at least one latching mechanism into a released position. The operating structure may be configured as a cable or any other suitable operating device. The posts may be hollow, and the operating structure may extend from the hub assembly to the at least one latching mechanism through at least one of the posts. The base assembly may include upper and lower base legs in an X-shaped configuration.

Each latching mechanism may include: a first leg having a first end pivotally connected to and extending from the upper portion of one of the posts and a second end; a second leg having a first end pivotally connected to the second end of the first leg and a second end connected to a portion of one of the arm assemblies of the upper assembly; and a locking member having a first end pivotally coupled to the upper portion of one of the posts between an end of the post and a position where the first end of the first leg is coupled to the upper portion of the post and a second end connected between the first leg and the second leg. The first leg and the second leg may extend between the upper portion of one of the posts and the portion of one of the arm assemblies when the foldable structure is in the open position, and the first leg may be nested inside the second leg, and the first and second legs are positioned between the at least one post and the at least one arm assembly when the foldable structure is in the closed position. The locking member may be positioned perpendicular to the first leg and the second leg when the foldable structure is in the open position, and the locking member may be nested within the first leg when the foldable structure is in the closed position.

According to another embodiment of the invention, the foldable structure includes: an upper assembly having a plurality of upper arms; a base assembly having a plurality of base legs; a side structure having a plurality of side posts connecting the upper assembly to the base assembly; and a centrally-located hub assembly that causes the apparatus to move between a closed position and an open position. The apparatus is prevented from moving from an open position to a closed position by at least one latching mechanism provided on at least one corner of the upper assembly.

According to still another embodiment of the invention, the foldable includes: an structure defining a space within; a hub assembly centrally-located at a bottom of the structure; and a latching mechanism operatively coupled to the hub assembly and provided on at least one corner of the structure. The latching mechanism includes: a first leg having a first end pivotally connected to and extending from an upper portion of a vertical post of the structure and a second end; and a second leg having a first end pivotally connected to the second end of the first leg and a second end pivotally connected to a portion of an arm assembly of an upper assembly of the structure. The hub assembly is movable in a linear vertical direction such that movement of the hub assembly causes at least one of engagement or disengagement of the latching mechanism.

The first leg and the second leg may extend between the upper portion of the vertical post and the portion of the arm assembly when the foldable structure is in an open position, and the first leg may be nested inside the second leg, and the first and second legs are positioned between the vertical post and the arm assembly when the foldable structure is in a closed position. The latching mechanism may further include: a locking member having a first end pivotally coupled to the upper portion of the vertical post between an end of the vertical post and a position where the first end of the first leg is coupled to the upper portion of the vertical post, and a second end connected between the first leg and the second leg. The locking member may be positioned perpendicular to the first leg and the second leg when the foldable structure is in the open position, and the locking member may be nested within the first leg when the foldable structure is in the closed position.

According to yet another embodiment of the invention, a foldable structure includes: an upper assembly forming an upper portion of the structure; a centrally-located hub assembly operatively connected to the upper assembly; and a post extending from each corner of the upper assembly. The upper assembly includes a plurality of arm assemblies. At least one latching mechanism is provided at each corner of the upper assembly extending from an upper portion of at least one of the posts to a portion of at least one of the arm assemblies. Movement of the hub assembly towards a surface upon which the foldable structure is positioned causes the foldable structure to move from a folded position to an opened position, and movement of the hub assembly away from the surface causes the foldable structure to move from the open position to the folded position.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
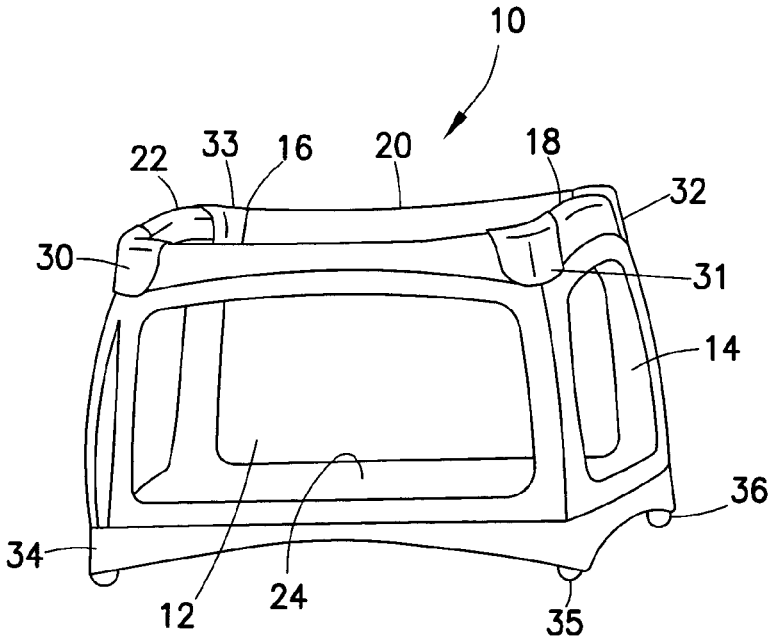
FIG. 1 is a perspective view of a foldable structure shown in an opened or deployed position in accordance with one embodiment of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
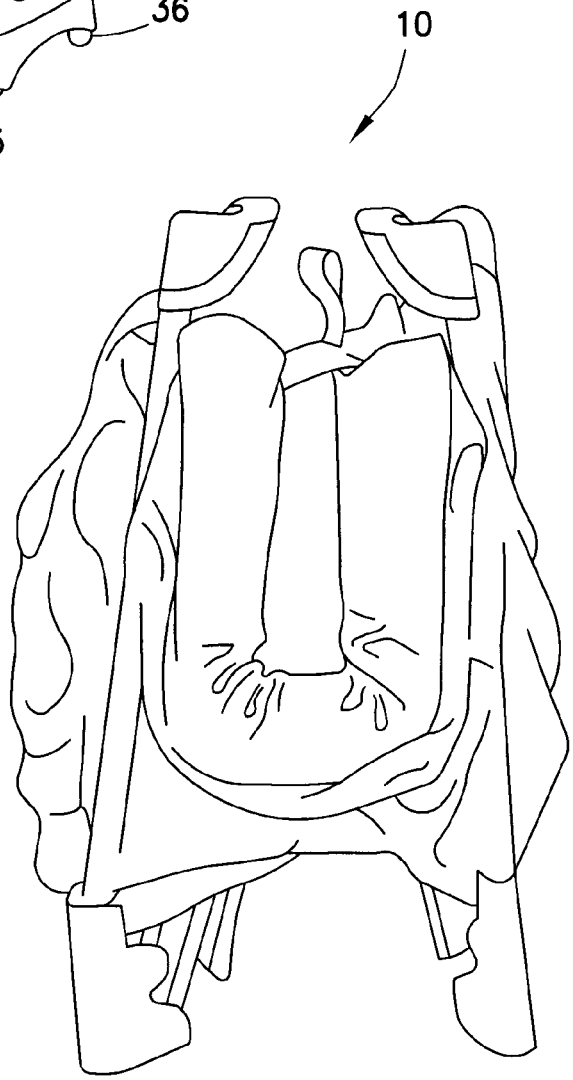
FIG. 2 is a perspective view of the structure shown in FIG. 1 in a folded or closed position.
Figure 7:
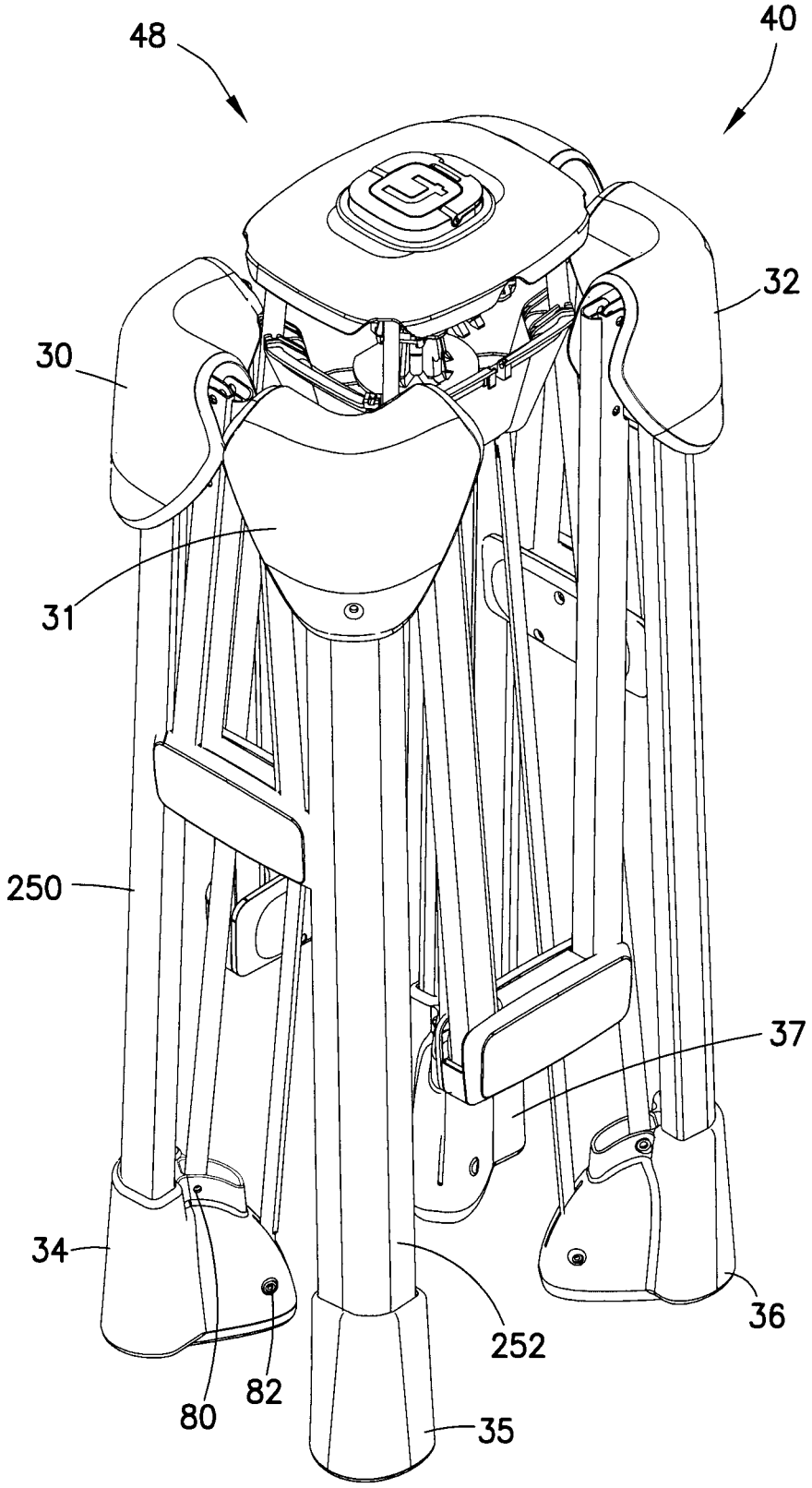
FIG. 7 is a perspective view of the frame of FIG. 3 in a folded position.

With reference to FIGS. 1 and 2, a foldable child enclosure apparatus 10 configured in the form of a play yard or playpen is illustrated. The play yard is portable and, as such, is foldable, closable, or collapsible so as to move between an opened, deployed position, as shown in FIG. 1, for use, and a folded, collapsed, or closed position as shown in FIG. 2, for transport and/or storage. The play yard may have soft, flexible mesh sides, such as sides 12, 14, fabric coverings, such as fabric coverings 16, 18, 20, 22, a base pad or mattress 24, and decorative and protective upper and lower corners, such as the four upper corners 30, 31, 32, 33, and the four lower corners, of which only three lower corners 34, 35, 36 are shown. Side padding (not shown) may also be placed around the interior of the play yard for added protection of a child placed on the pad or mattress 24. Storage devices, child seats, bassinets and the like may also be mounted on and to the play yard although they are not shown here. Under the mesh, the fabric, the pad, and any side padding is a foldable frame, denoted generally as reference numeral 40, as shown in an opened position in FIGS. 3-6 and in a folded position in FIG. 7.

With reference to FIGS. 3-6, to better understand the invention, the detailed description of the foldable frame 40 set forth hereafter may best be understood by dividing the foldable frame 40 into four portions. The frame 40 includes a base assembly, denoted generally as reference numeral 42, forming a lower portion of the frame 40, an upper assembly, denoted generally as reference numeral 44, forming an upper portion of the frame 40, a side structure, denoted generally as reference numeral 46, and a centrally-located hub assembly, denoted generally as reference numeral 48. The base assembly 42 is pivotally connected to both the hub assembly 48 and to the side structure 46, and the upper assembly 44 is pivotally connected to the side structure 46.

The base assembly 42 includes four upper base legs 50, 52, 54, 56, and four lower base legs 60, 62, 64, 66, four lower corners 34, 35, 36, 37, a pair of stability legs 70, 72 and pivot rivets, such as the rivets 80, 82 around which the upper base leg 50 and the lower base leg 60 pivot or rotate relative to the corner 34. Each quarter of the frame is constructed in the same manner so that only the left portion of the frame as shown in FIGS. 3-6 will be detailed. The base legs are configured as shown in an "X" pattern and no side structure or elements are present as in many conventional play yard devices. The lower corners each include a wheel or caster, such as the wheel 86.

The upper assembly 44 includes eight upper aims 140, 142, 144, 146, 148, 150, 152, 154, upper four corner assemblies 30, 31, 32, 33, and four stiffening members 170, 172, 174, 176. As was earlier done, only a portion of the frame will be detailed because all other like structures of the frame are identically configured. The upper arm 140 is pivotally connected to a corner by a rivet 180 and to the stiffening member 170 by a rivet 182. The upper arm 154 that is positioned perpendicular to the upper arm 140 is pivotally connected to the corner by a rivet 184 and to the stiffening member 176 by a rivet 186. The remaining upper arms are arranged in a similar fashion.

The side structure 46 includes four generally vertically disposed side posts 250, 252, 254, 256. Each side post 250, 252, 254, 256 is connected to a respective lower corner and to a respective upper corner. This arrangement permits the side posts to pivot or tilt outwardly and, at the same time, pull the upper corner assemblies outwardly or apart from one another. Each side post also encloses an operative structure that may take the form of a cable as described in greater detail hereinafter. Accordingly, the operative structure is in mechanical communication with the upper arms of the upper assembly and the base assembly to move the upper arms to positions consistent with an opened enclosure and positions consistent with a folded enclosure in response to movement of the base assembly.

Figure 3:
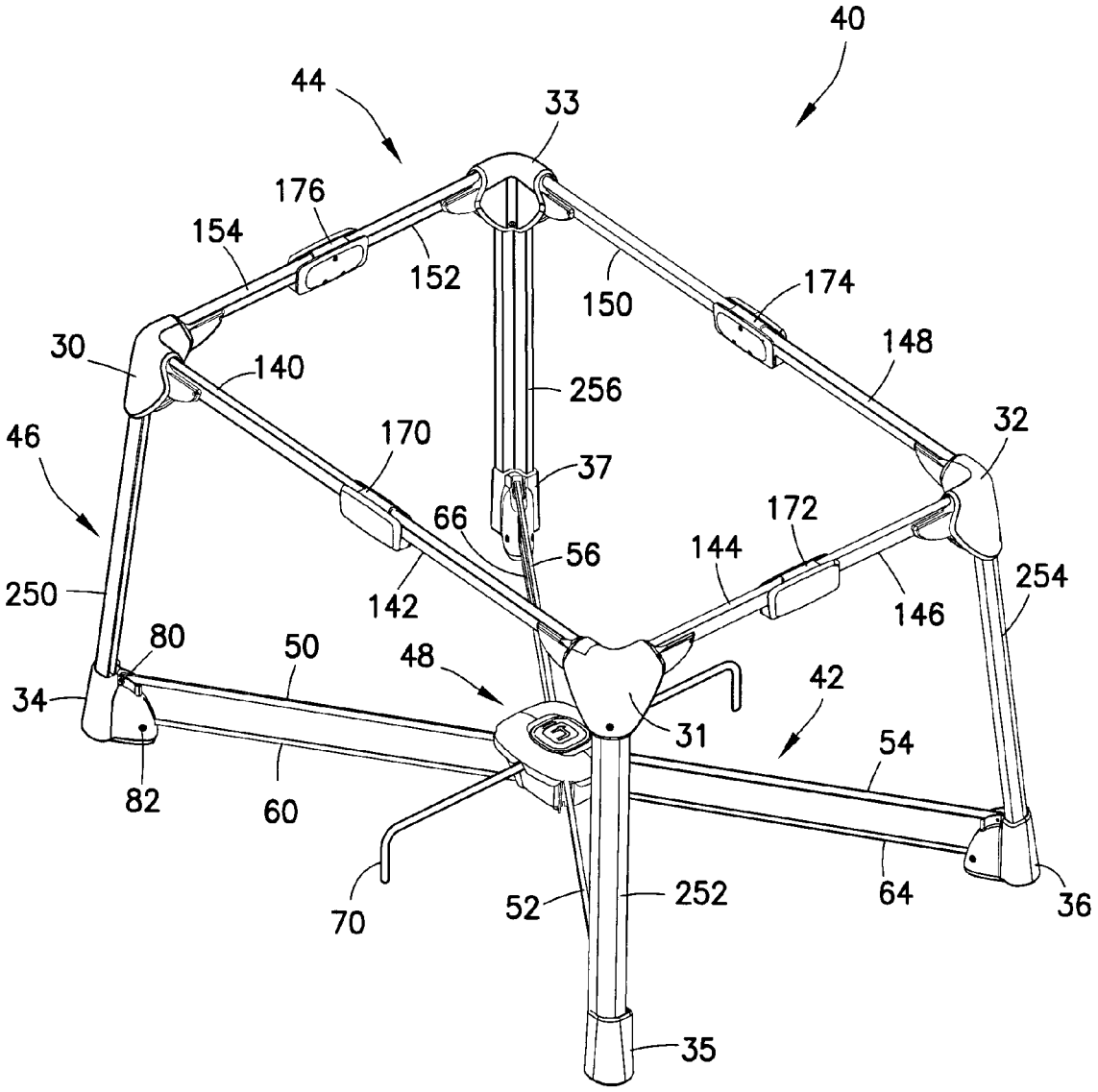
FIG. 3 is a perspective view of a frame of the foldable child structure shown in FIG. 1.
Figure 4:
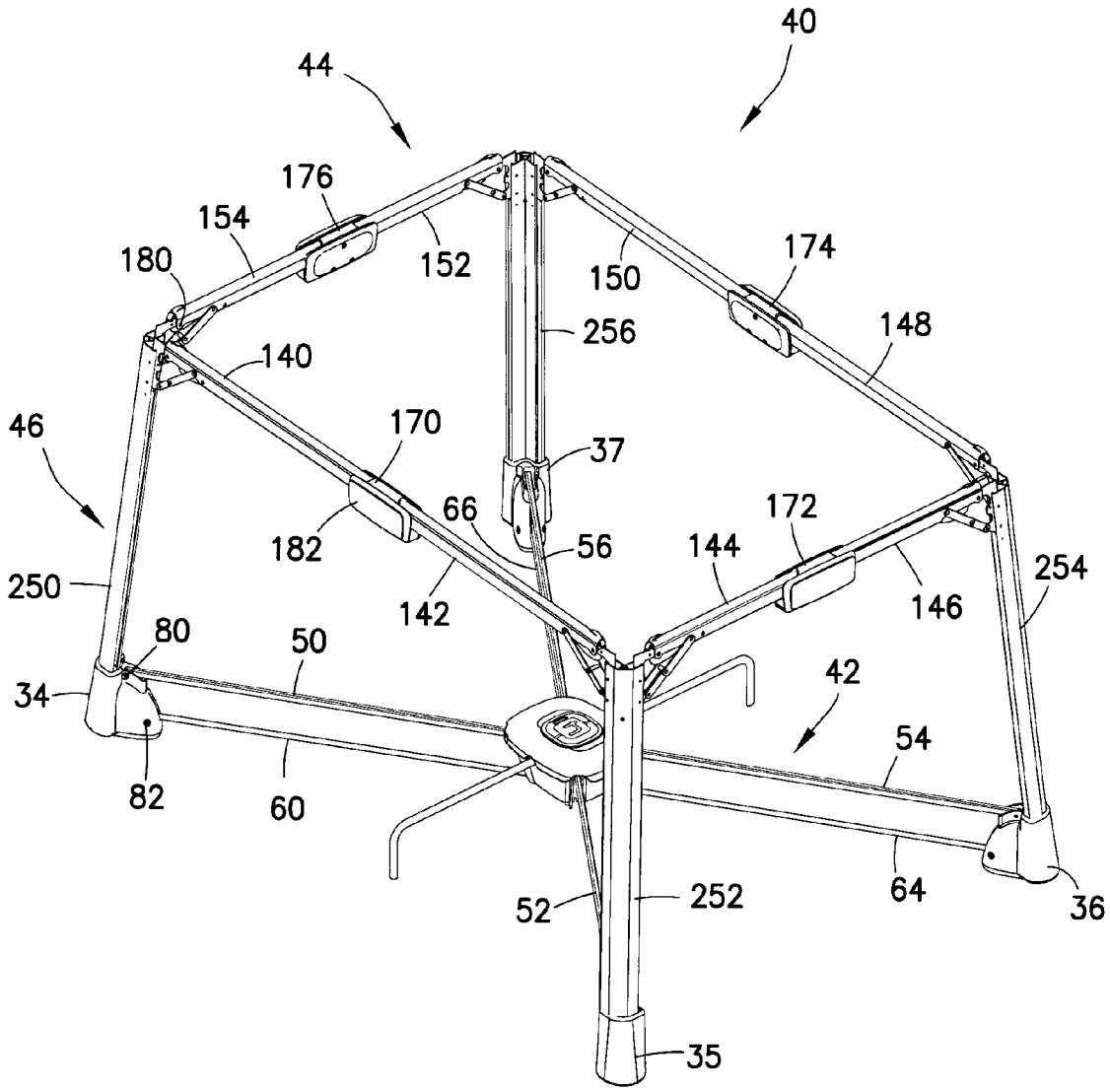
FIG. 4 is a perspective view of the frame of FIG. 3 with the upper corners removed.
Figure 5:
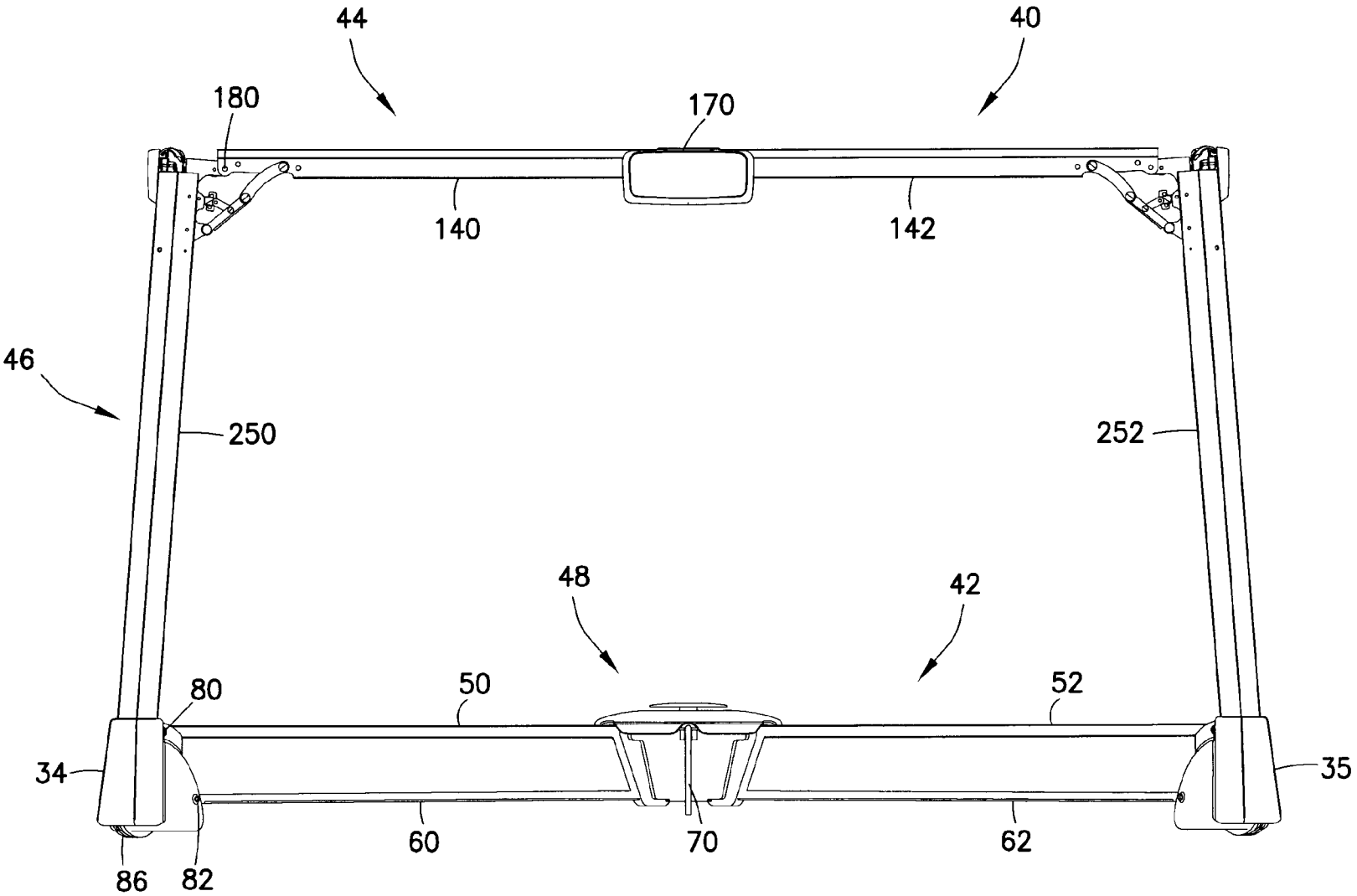
FIG. 5 is a front plan view of FIG. 4.
Figure 6:
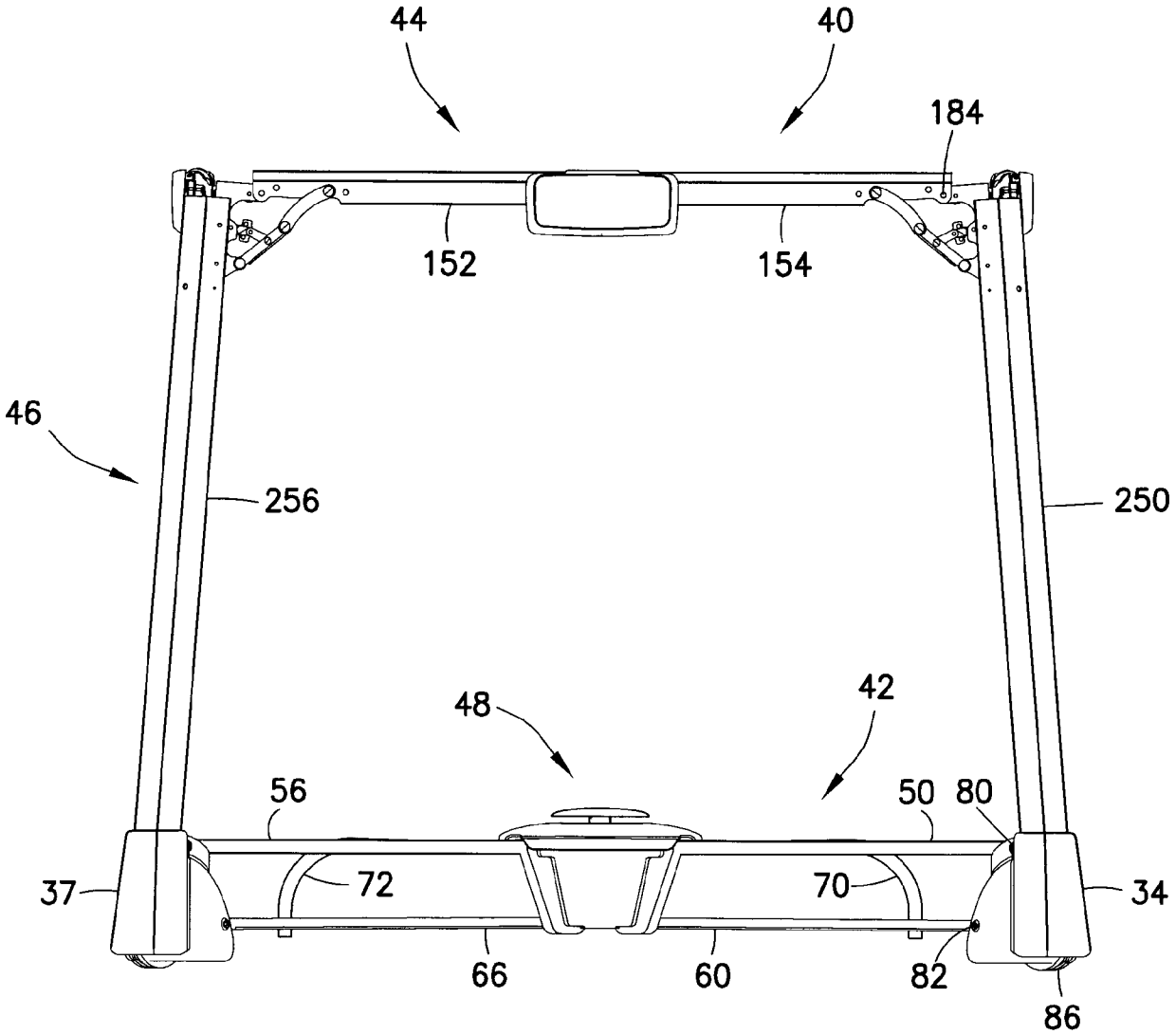
FIG. 6 is a left side plan view of FIG. 4.
Figure 8A:
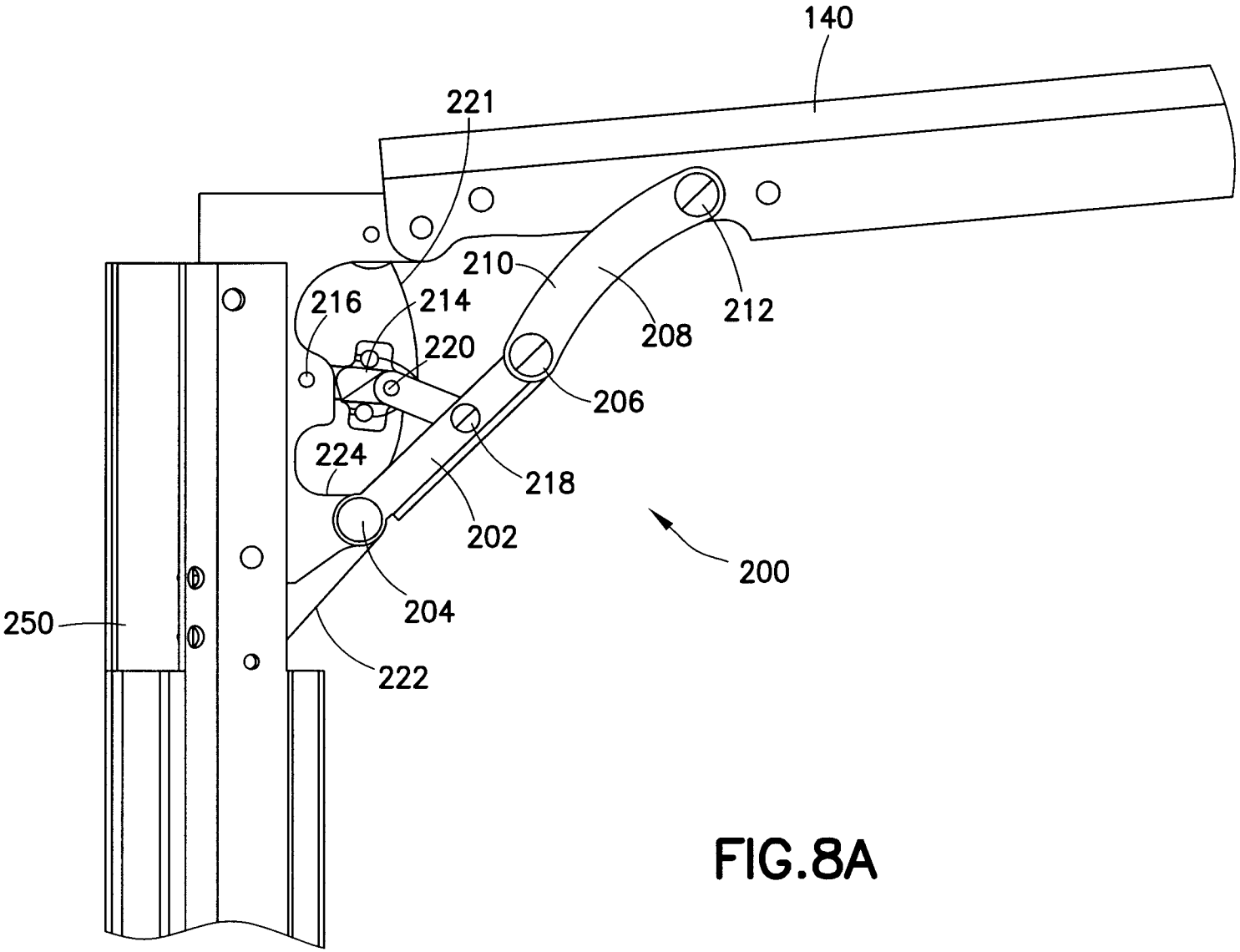
FIG. 8A is a side view of the portion of the frame of FIG. 4 in the opened position.
Figure 8B:
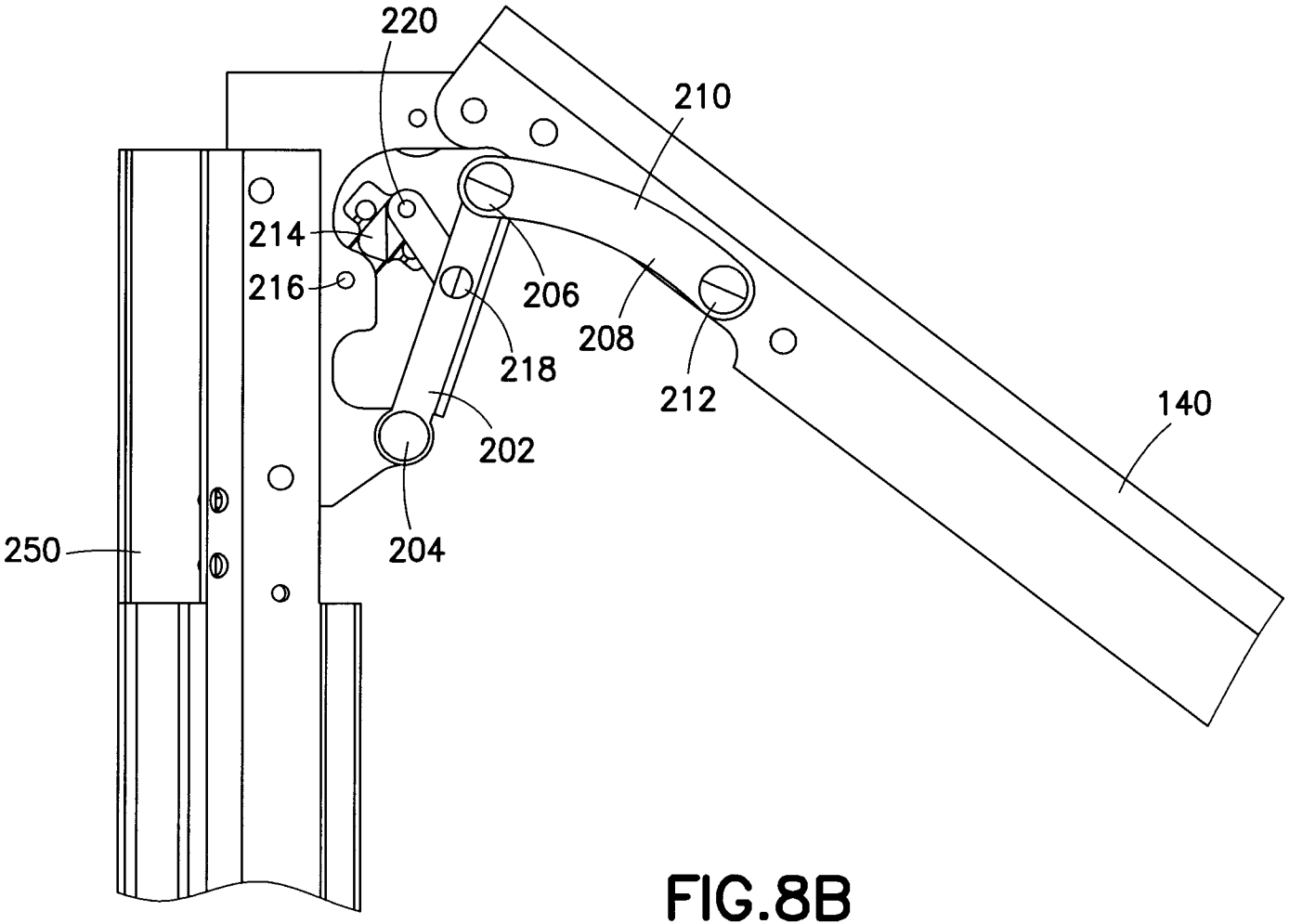
FIG. 8B is a side view of the portion of the frame of FIG. 4 in the partially-opened position.
Figure 8C:
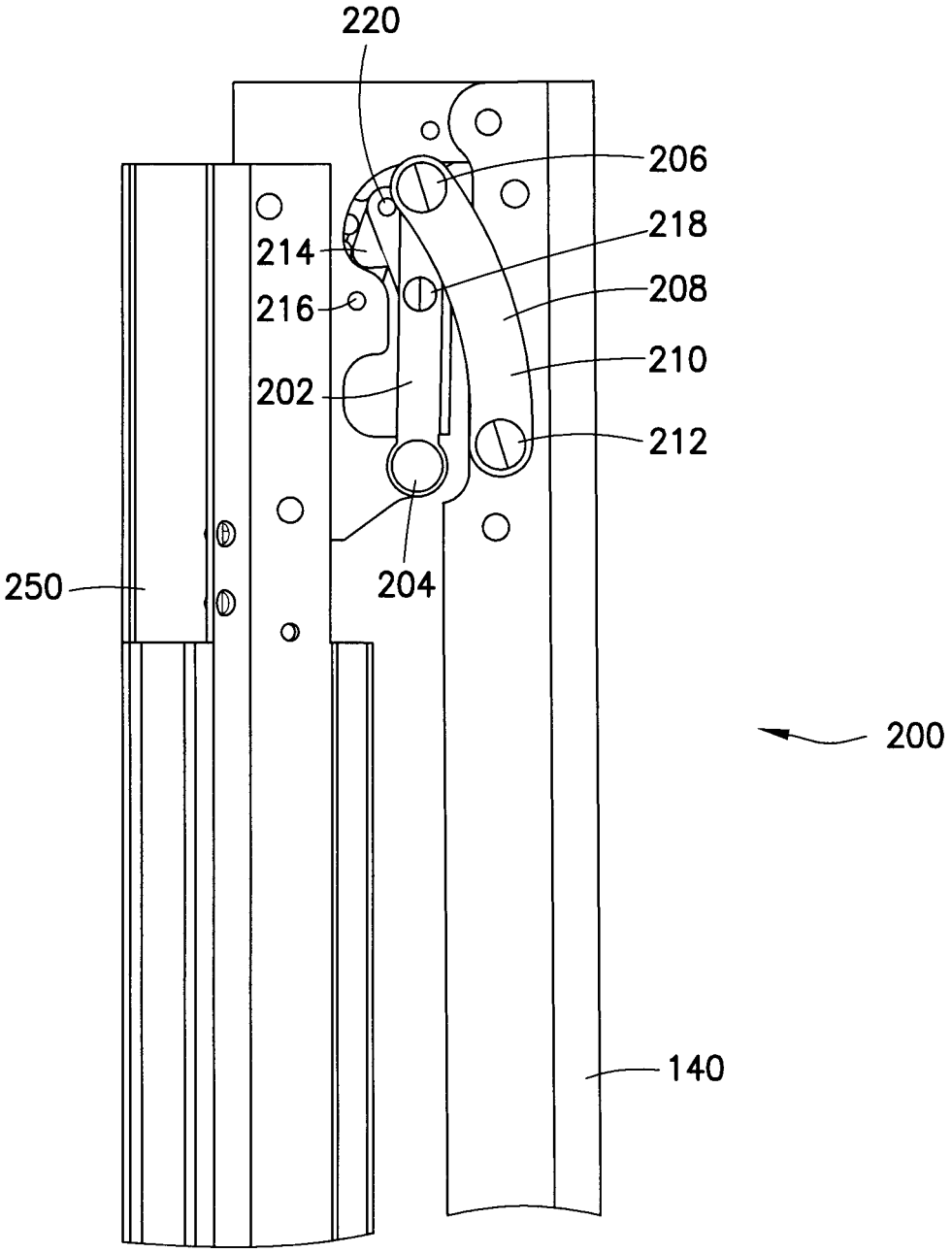
FIG. 8C is a side view of the portion of the frame of FIG. 4 in the folded position.

Each corner of the foldable frame 40 includes a latching mechanism 200 as can be seen in FIGS. 4 and 5 where the upper corners 30, 31, 32, 33 have been removed. As was earlier done, only one of the latching mechanisms of the frame will be detailed because all other like latching mechanisms of the frame are identically configured. With reference to FIGS. 8A-8C, and with continued reference to FIGS. 3-7, the latching mechanism 200 is illustrated in three stages of deployment: opened, partially-opened, and closed positions. Latching mechanism 200 includes a first leg 202 having a first end 204 pivotally connected to and extending from an upper portion of the side post 250 and a second end 206; a second leg 208 having a first end 210 pivotally connected to the second end 206 of the first leg 202 and a second end 212 connected to a portion of the upper arm 140 of the upper assembly 44; and a locking member 214 having a first end 216 pivotally coupled to the upper portion of the side post 250 between an end of the side post 250 and a position where the first end 204 of the first leg 202 is coupled to the upper portion of the side post 250 and a second end 218 connected between the first leg 202 and the second leg 208. The locking member 214 includes a central pivoting member 220 that is operatively coupled to the lower corner 34 by an operating structure, such as a first cable 221 and second cable 222. First cable 221 is secured to a lower end of central pivoting member 220 and extends upward around an upper portion of side post 250 into a hole (not shown) in side post 250 and to the lower corner 34. The second cable 222 extends from an upper end of the central pivoting member 220 over a wheel 224 provided at the first end 204 of the first leg 202, into a hole (not shown) in the side post 250, and to the lower corner 34.

As shown in FIGS. 8A and 8B, the first leg 202 and the second leg 208 are configured to extend between the upper portion of the side post 250 and the portion of the upper arm 140 when the foldable frame 40 is in the open position. The locking member 214 is positioned offset from the first leg 202 and the second leg 208 when the foldable frame 40 is in the open position, thereby preventing movement between the first leg 202 and the second leg 208. With reference to FIG. 8C, the first leg 202 is nested inside the second leg 208, the locking member 214 is nested inside the first leg 202, and the first and second legs 202, 208 and the locking member 214 are positioned between the side post 250 and upper arm 140 when the foldable frame 40 is in the closed position. In this configuration, the nested arrangement of the first leg 202, the second leg 208, and the locking member 214 desirably provide a sufficient distance between the side post 250 and upper arm 140 in order to prevent a pinching hazard.

Figure 9:
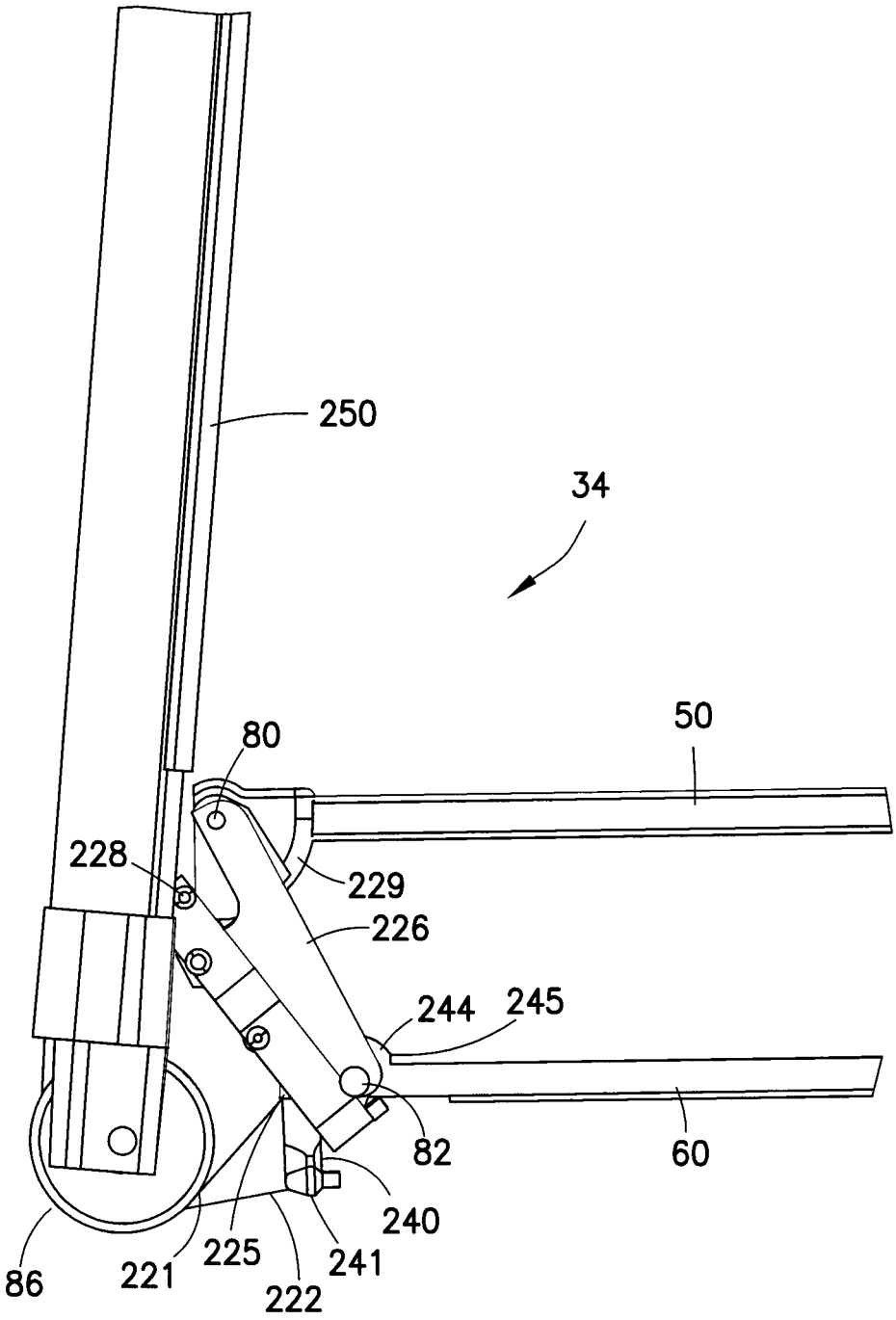
FIG. 9 is a side view of one of the lower corners of the frame of FIG. 4 in the opened position.
Figure 10:
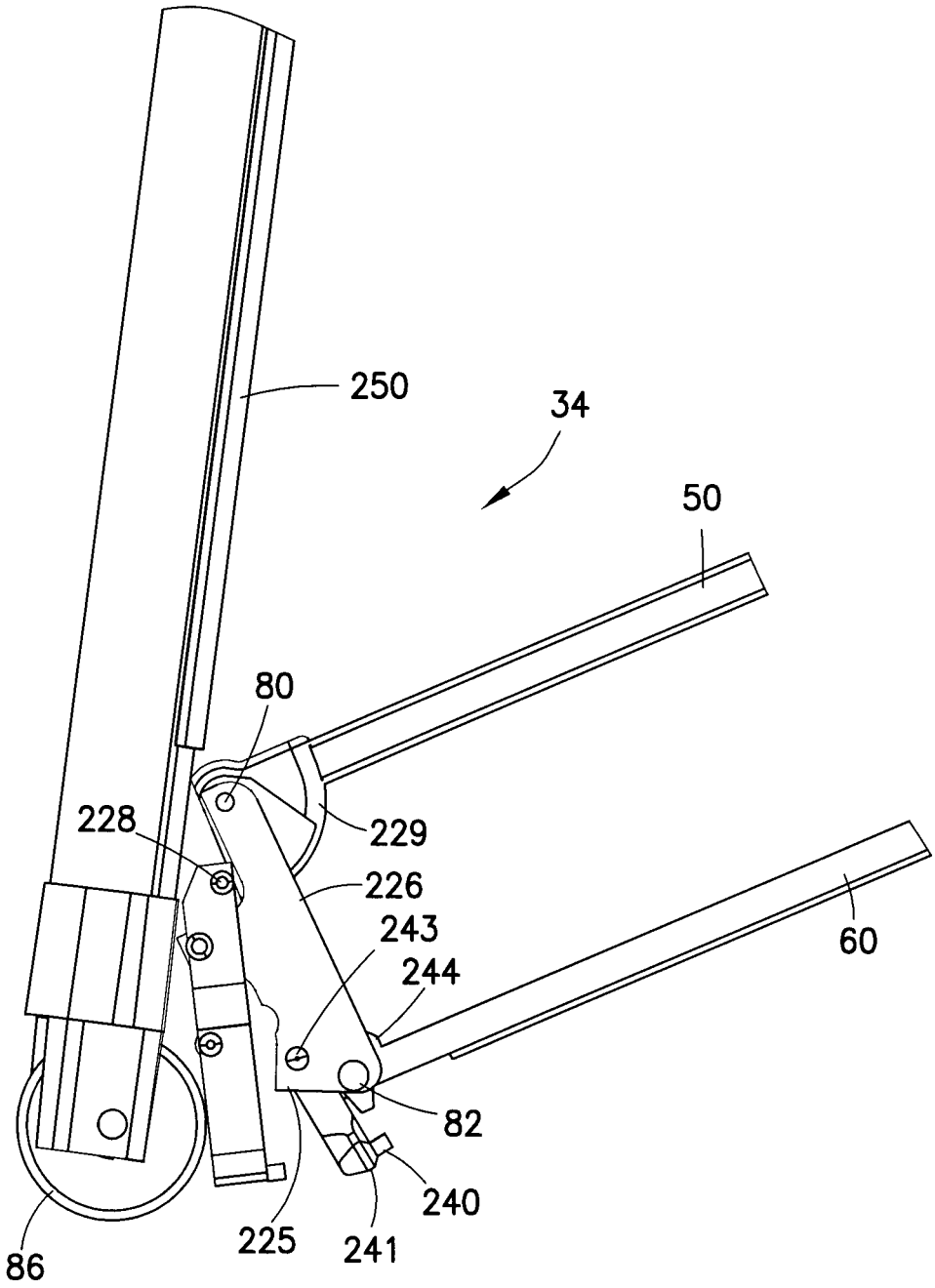
FIG. 10 is a side view of one of the lower corners of the frame of FIG. 4 in the partially-opened position.
Figure 11:
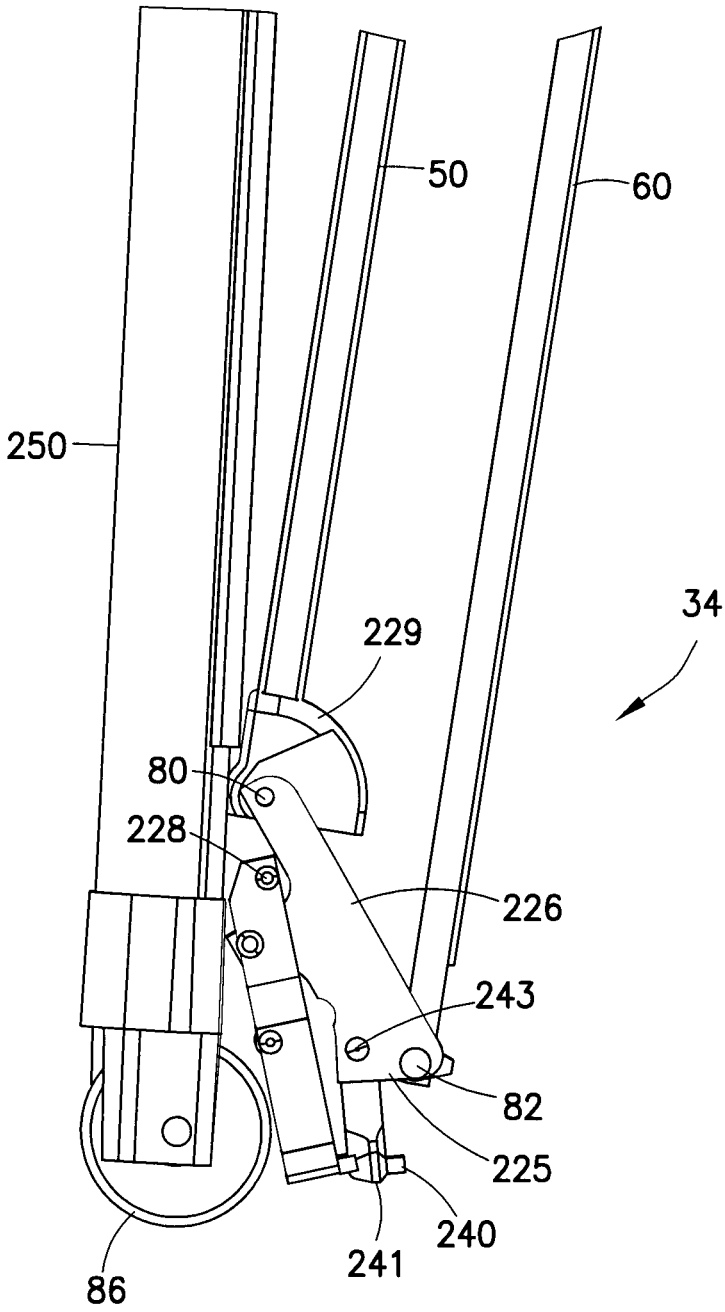
FIG. 11 is a side view of one of the lower corners of the frame of FIG. 4 in the folded position.

With reference to FIGS. 9-11, a side view of one of the lower corners of frame 40 is illustrated in various stages of opening. While a lower corner 34 is used for purpose of illustrating the components in FIGS. 9-11, the remaining three lower corners 35, 36, 37 have identical components and function in an identical way. FIG. 9 shows the lower corner in an opened position with upper base leg 50 and lower base leg 60 in a deployed configuration. FIG. 10 shows the same components illustrated in FIG. 9 in a partially-opened position as frame 40 is advanced from a folded configuration to an opened configuration, or vice versa. FIG. 11 shows the lower corner in a closed position with upper base leg 50 and lower base leg 60 in a folded configuration.

As briefly described hereinabove with regard to FIGS. 8A-8C, the first and second cables 221, 222 are connected to the central pivoting member 220 of the locking member 214. The cables 221, 222 then extend downward through the side post 250. Referring back to FIGS. 9-11, first cable 221 extends into the lower corner 34 around wheel 86 and is connected to a lower end 241 of a locking link member 240. An upper end 242 of locking link member 240 is pivotally coupled to lower base leg 60 at pivot point 243. Adjacent to the pivot point 243 is a cam 244 provided at a terminal end of lower base leg 60. Cam 244 has a notch 245 to actuate the locking link member 240 to unlock the upper corner. When lower base leg 60 is moved from the folded to the opened position, cam 244 pivots about pivot point 243. A tensioning force in the first cable 221 at lower end 241 of locking link member 240 causes further pivoting of cam 244 about pivot point 243. In a fully opened position, upper end 242 of locking link member 240 slides over the locking notch 245 to lock the lower corner assembly in place. When the lower base leg 60 is moved from the open to the folded position, upper end 242 of locking link member 240 slides over the locking notch 245 to unlock the lower corner assembly, thereby relieving the tensioning force and allowing the latching mechanism 200 to move from the locked position to the nested position discussed hereinabove.

With further reference to FIGS. 9-11, second cable 222 extends into the lower corner 34 around wheel 86 and is connected to a lower end 225 of a plate 226. An upper end 227 of the plate 226 is pivotally coupled to a lower end of the side post 250 at pivot point 228. A camming plate 229 is connected to each upper base leg 50, 52, 54, 56. The camming plate 229 is shaped and sized such that it comes into contact with the plate 226 as the upper base legs 50, 52, 54, 56 are moved from the folded to the open position. As the camming plate 229 comes into contact with the plate 226, it causes the plate 226 to rotate about its pivot point 228 and provide a tensioning force to the second cable 222. This tensioning force is transferred to the latching mechanism 200 to move the latching mechanism 200 to the locked position. When the upper base legs 50, 52, 54, 56 are moved from the open to the folded position, the contact between the camming plate 229 and the plate 226 is removed, thereby relieving the tensioning force and allowing the latching mechanism 200 to move from the locked position to the nested position discussed hereinabove.

The base legs, upper arms, and side posts may be formed of any suitable tubes, rails, bars, beams, shafts, spars, rods, or the like. Where applicable, any suitable cross-sectional configurations may be used, such as tubular, square, rectangular, I-beam, L-shaped, H-shaped, and C-shaped. Desirably, the side posts have a C-shaped cross-section as shown in the figures. An extrusion of sufficient strength and stiffness should suffice and the material may be plastic or metal or any other suitable material. The upper and lower corners may also be formed of plastic or metal or any other suitable material.

Figure 12:
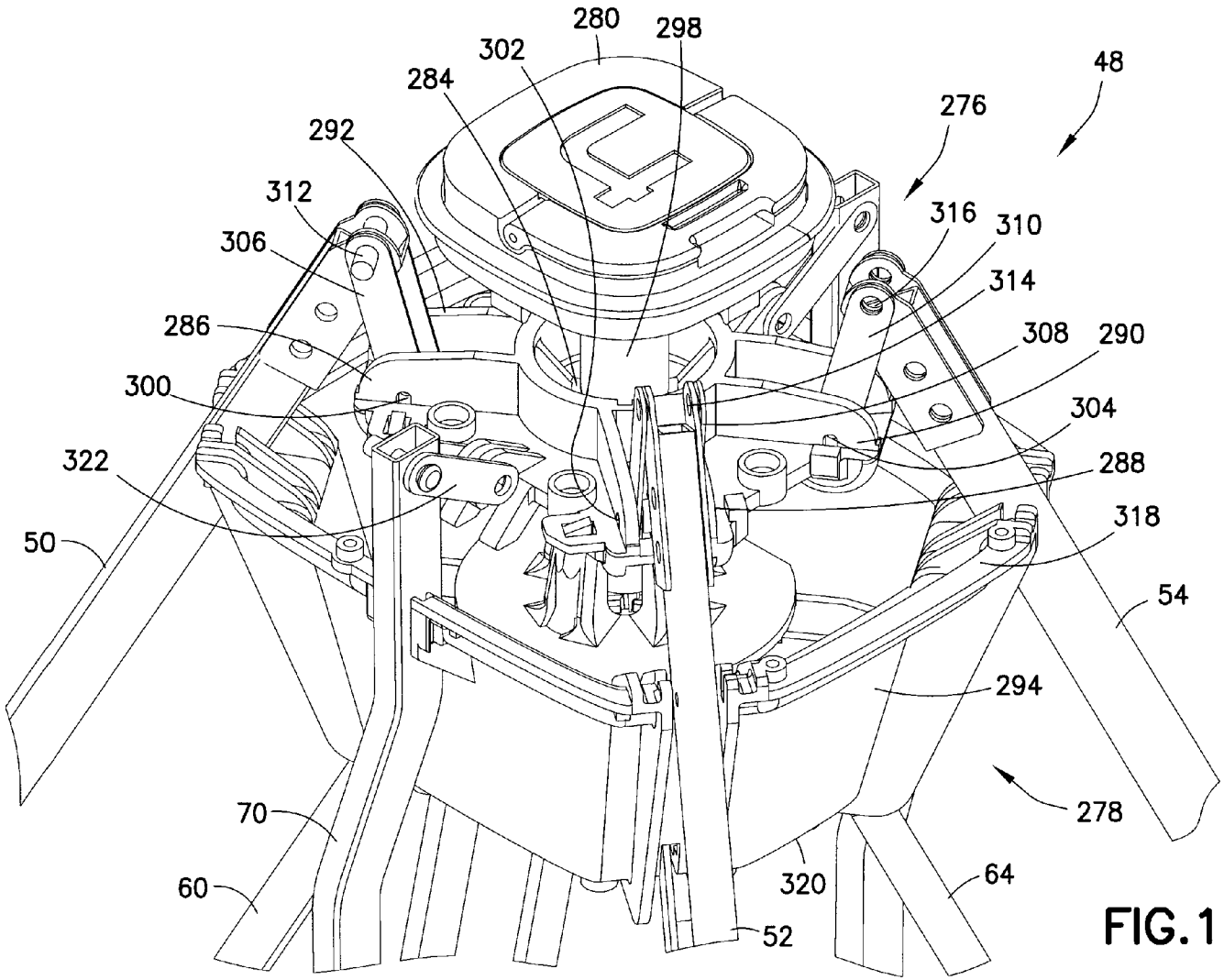
FIG. 12 is an enlarged downward looking perspective view of a hub assembly of the frame shown in FIG. 15.

With reference to FIG. 12 and with continued reference to FIGS. 3-11, the hub assembly 48 is configured as a two-part control system for the foldable child enclosure 10. The hub assembly 48 includes an upper housing 276 and a lower housing 278. The upper housing 276 includes a handle 280 and a collar 282. The collar 282 includes a central opening 284 and four brackets 286, 288, 290, 292 extending from and equally spaced around the collar 282. The lower housing 278 includes a generally bowl-shaped housing structure 294 that includes a mounting structure 296 positioned at a central bottom portion thereof. A sleeve 298 has a first end coupled to the lower housing 278 by the mounting structure 296 and a second end coupled to the handle 280. The sleeve 298 extends through the central opening 284 of the collar 282. The sleeve 298 is configured to keep the upper and lower housing parallel to each other and to the floor. Pivotally connected to the brackets 286, 288, 290, 292 of the collar 282 by four rivets (only three are shown 300, 302, 304) are four links (only three are shown 306, 308, 310). The four links 306, 308, 310 are pivotally connected at their opposite ends by four rivets (only three are shown 312, 314, 316) to the four upper base legs (only three are shown 50, 52, 54). The four upper base legs 50, 52, 54, 56 are further pivotally connected to the lower housing 278 along an upper edge 318 of the bowl-shaped housing structure 294 by four rivets (not shown). The four corresponding lower base legs 60, 62, 64, 66 are pivotally connected to the lower housing 278 along a lower edge 320 of the bowl-shaped housing structure 294. The pair of stability legs 70, 72 are pivotally connected to the collar 282 by a pair of links (only one shown 322) and are pivotally connected along the upper edge 318 of the bowl-shaped housing structure 294 by a pair of rivets. The sleeve 298 is configured to move vertically within the mounting structure 296 when a user moves the handle 280 either up or down.

A channel 281 extending around a periphery of the upper surface of handle 280 is provided for retaining a fabric covering (not shown in FIG. 12) extending across the bottom of foldable child enclosure apparatus 10. The fabric covering desirably covers the entire bottom surface of foldable child enclosure apparatus 10 and covers the top part of base assembly 42. The fabric covering may be removably attachable to handle 280 and along the perimeter of base assembly 42. A mattress pad (shown in FIG. 1) is placed on top of the fabric covering once foldable child enclosure apparatus 10 is deployed to an open position. Because the fabric covering is secured about the periphery of the upper surface of handle 280 and base assembly 42, the fabric covering moves along with the frame 40 as it is moved between a collapsed position and an open position.

Figure 16:
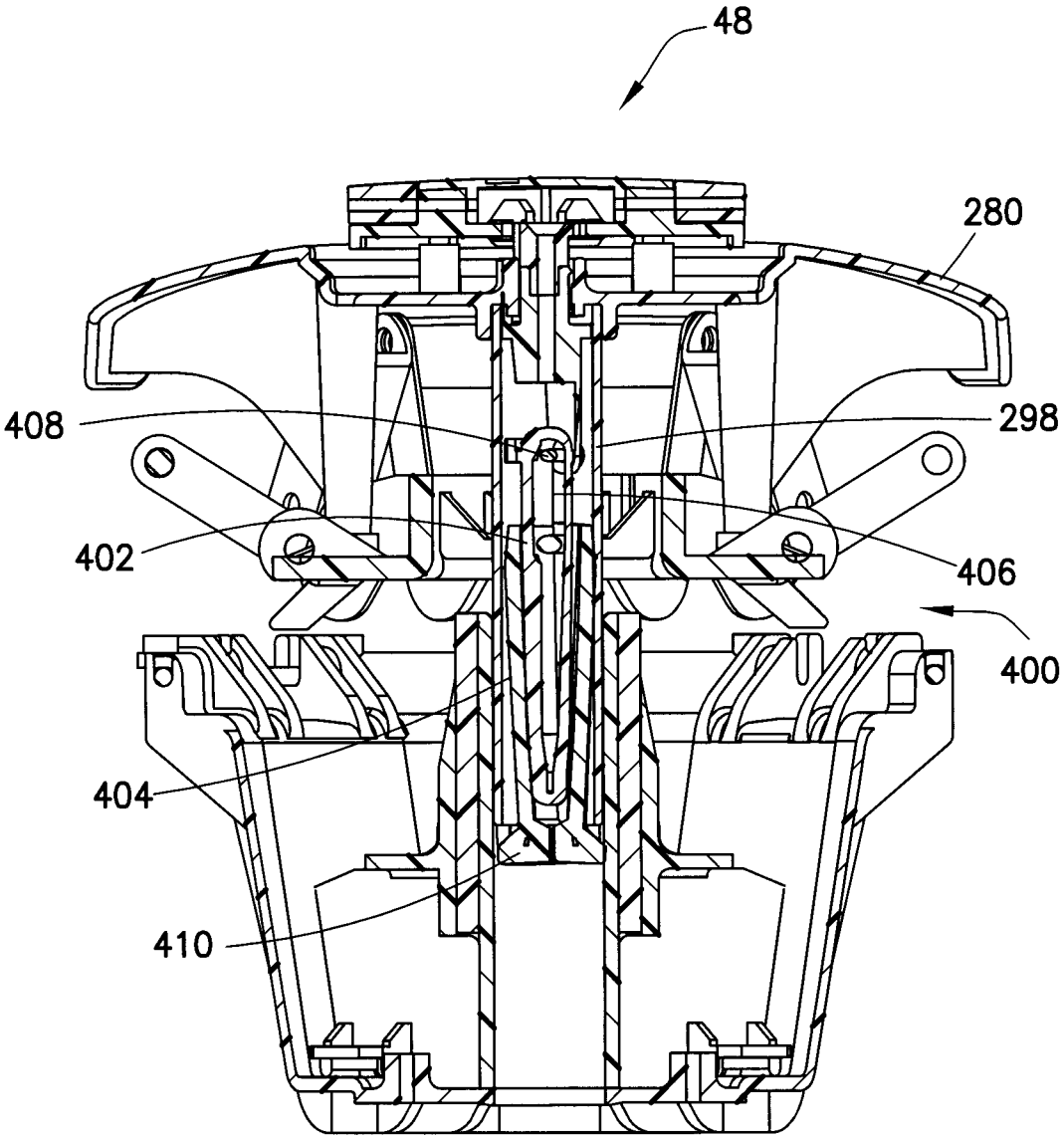
FIG. 16 is a cross-sectional view of the hub assembly shown when a frame is in a partially-opened position.
Figure 17:
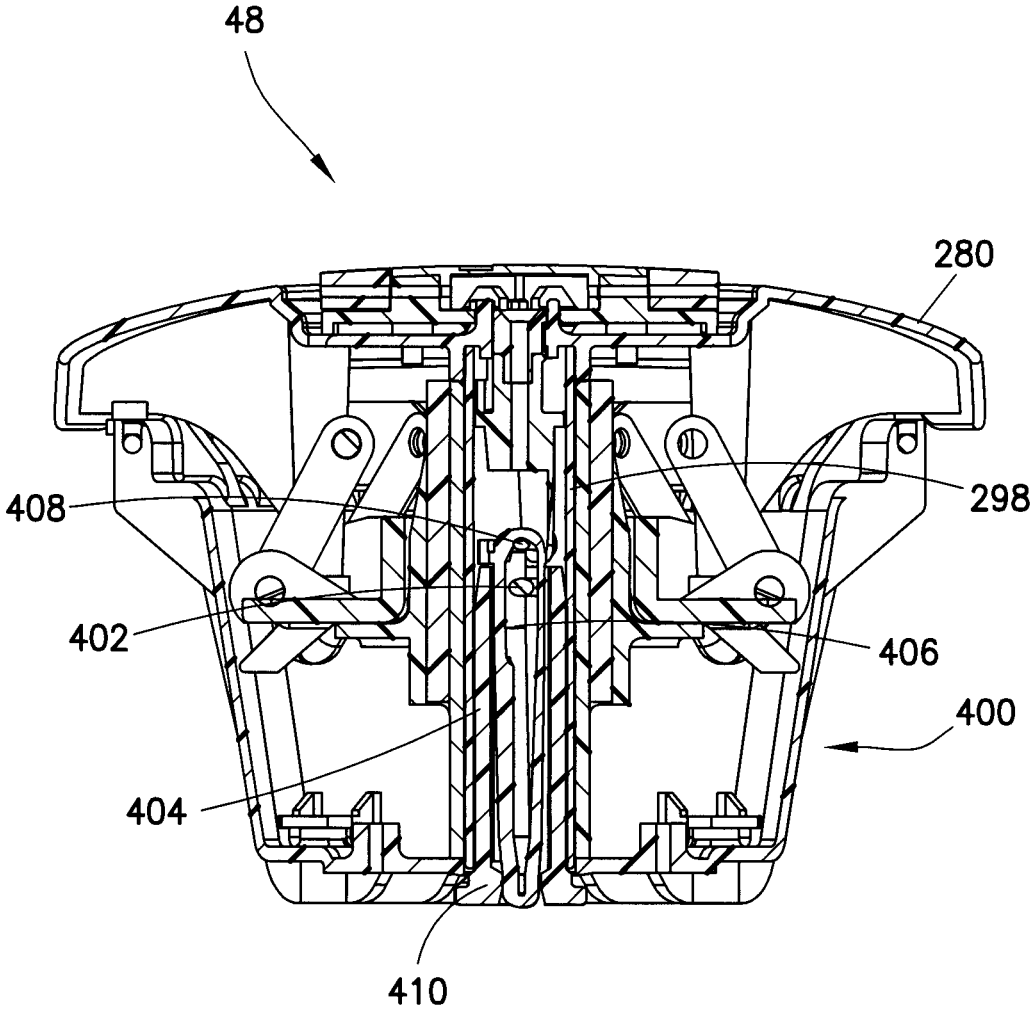
FIG. 17 is a cross-sectional view of the hub assembly shown when a frame is in a fully-opened position.

With reference to FIGS. 16-17, hub assembly 48 further includes a safety detent 400 that latches the hub assembly 48 once it is fully deployed in the open position in order to prevent unintentional folding of the hub assembly 48 back in the collapsed position. Safety detent 400 includes a sliding pin 402 and a pair of locking legs 404 disposed within sleeve 298. Both the sliding pin 402 and the locking legs 404 can move axially within sleeve 298. Each locking leg 404 includes a foot 410 extending in a radially-outward direction with respect to the central axis of sleeve 298. Sliding pin 402 includes a through opening 406 provided adjacent to handle 280. A pin 408 is positioned within through opening 406 and is secured with respect to sleeve 298 such that axial movement of sliding pin 402 is limited by the length of through opening 406. Downward movement of sliding pin 402 caused by a downward movement of handle 280 also causes a corresponding downward movement of locking legs 404. In a first position (shown in FIG. 16), such as when frame 40 is collapsed, both the sliding pin 402 and the locking legs 404 are contained within sleeve 298. As frame 40 is advanced toward an open position by pushing on handle 280, sliding pin 402 and locking legs 404 are advanced in a downward direction within sleeve 298. In a second position (shown in FIG. 17), such as when frame 40 is opened, handle 280 is advanced in a downward direction until sliding pin 402 pushes the locking legs 404 through an open bottom part of sleeve 298 such that the foot 410 of each locking leg 404 extends radially outward with respect to the perimeter of sleeve 298 to lock hub assembly 48 from unintentionally withdrawing back to the first position. In order to return frame 40 to the first, collapsed position (shown in FIG. 16), a user must pull on handle 280 with sufficient force to cause the feet 410 of locking legs 404 to withdraw into sleeve 298.

Figure 13:
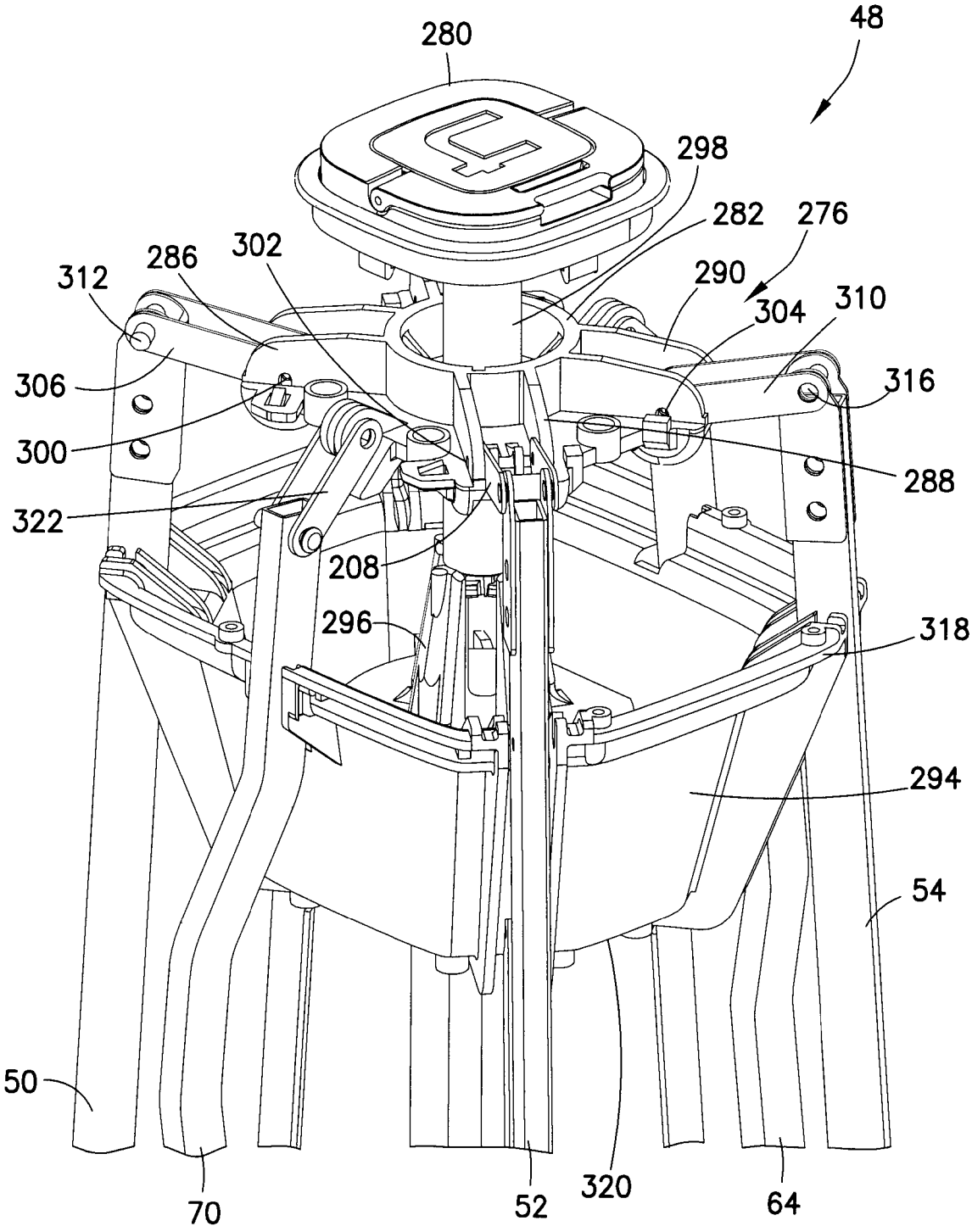
FIG. 13 is an enlarged downward looking perspective view of the hub assembly of the frame in FIG. 7.

When a user wishes to take the folded enclosure and cause it to deploy, the user simply pushes the handle 280 downwardly. As shown in FIG. 13, the links 306, 308, 310 are generally positioned at an angle slightly above the horizontal arrangement of the brackets 286, 288, 290, 292 of the collar 282 and offer great leverage when pushing the handle 280 and the sleeve 298 downward. The leverage achieved is a major advantage of the present invention. At one end, each link pivots easily relative to the collar, and at the other end, a strong moment arm is created to easily pivot each upper base leg 50, 52, 54, 56. The lower base legs 60, 62, 64, 66 follow by pivoting relative to the lower edge 320 of the bowl-shaped housing structure 294. The base legs also pivot relative to the lower corners and cause the cables to force the latching mechanisms 200 to their locked position, thereby causing the rotation of the upper arms 140, 142, 144, 146, 148, 150, 152, 154.

Operation of the foldable frame 40 will now be described with reference to the figures. As discussed hereinabove, the operation of the foldable frame 40 can be described as a three-phase process through a single interface. In the first phase, the user pushes down on the centrally-located hub assembly 48 which causes the legs of the base assembly 42 to spread apart. In the next phase, the legs of the base assembly 42 maintain the side posts of the enclosure at a substantially vertical position. In the final phase, latches provided in the upper corners of the enclosure lock the enclosure in the unfolded or open state. These positions of the frame 40 will be illustrated, analyzed, and described in detail, in sequence from folded to open and back to folded. This is done by a study of the positions of the hub assembly 48, the latching mechanism 200, the base assembly 42, and the upper assembly 44, in each of the six positions of the frame 40.

Figure 14:
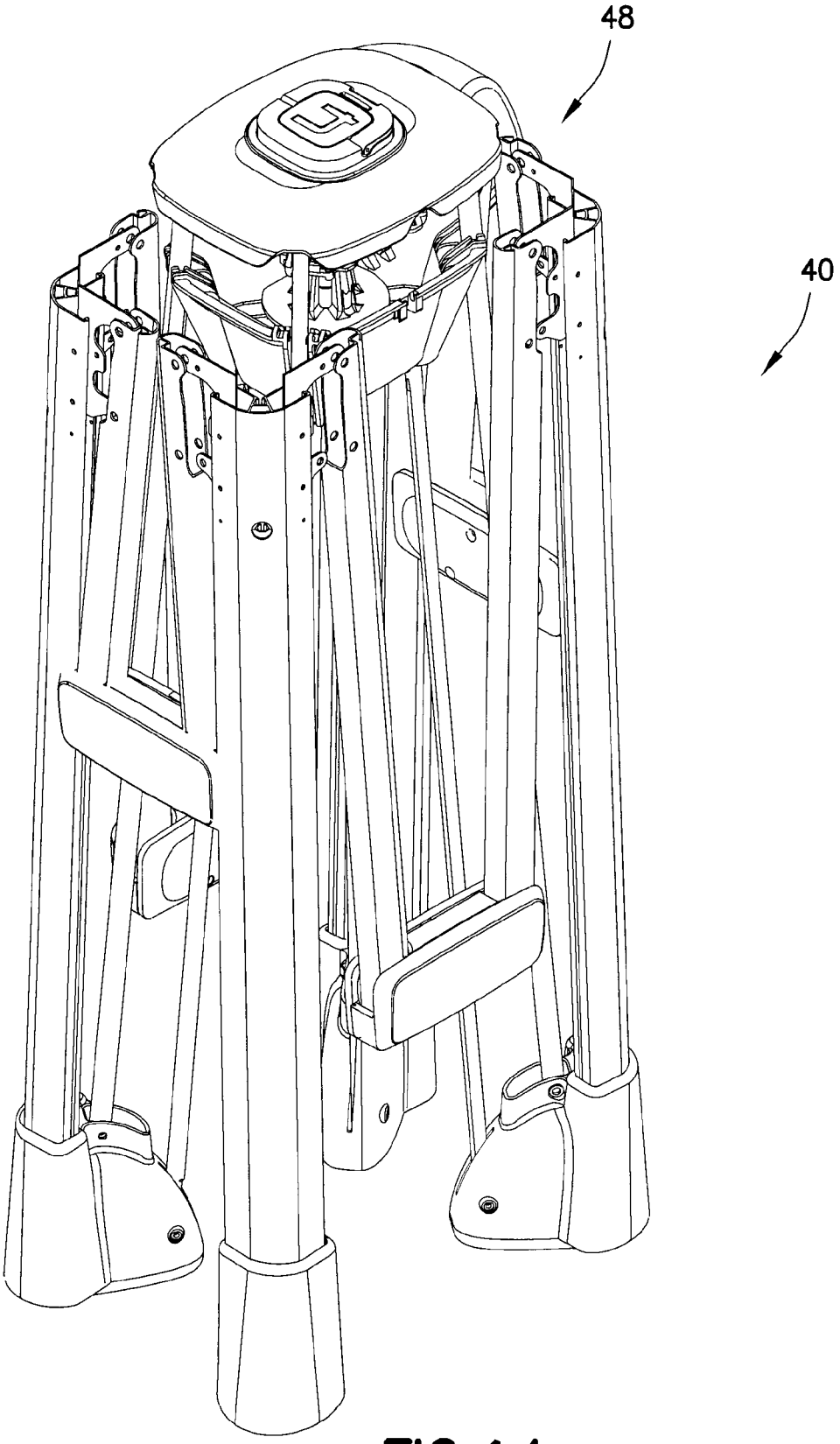
FIG. 14 is a perspective view of the frame of FIG. 4 in the folded position.

Referring first to FIG. 14, the frame 40 is in a folded position. The hub assembly 48, as shown in FIG. 13, is at the top of its cycle. The base legs are rotated upwardly to generally vertical positions and all of the upper arms are rotated downwardly to the same generally vertical positions. The hub links 306, 308, 310 are positioned at an angle slightly above the generally horizontal orientation of the brackets 286, 288, 290, 292 of the collar 282 to give excellent leverage for opening the frame 40 as shown in FIG. 13. The latching mechanisms 200 are disengaged and nested between the respective upper arm and side post such that the upper arms point downwardly. The base legs are positioned upwardly and the camming plate 229 is not in contact with the plate 226 and no tension is provided on the cable 222. In the folded position, the frame and, thereby, the play yard enclosure, are compactly arranged and are stable and may be covered or packaged so that the enclosure may be easily carried and/or stored.

Figure 15:
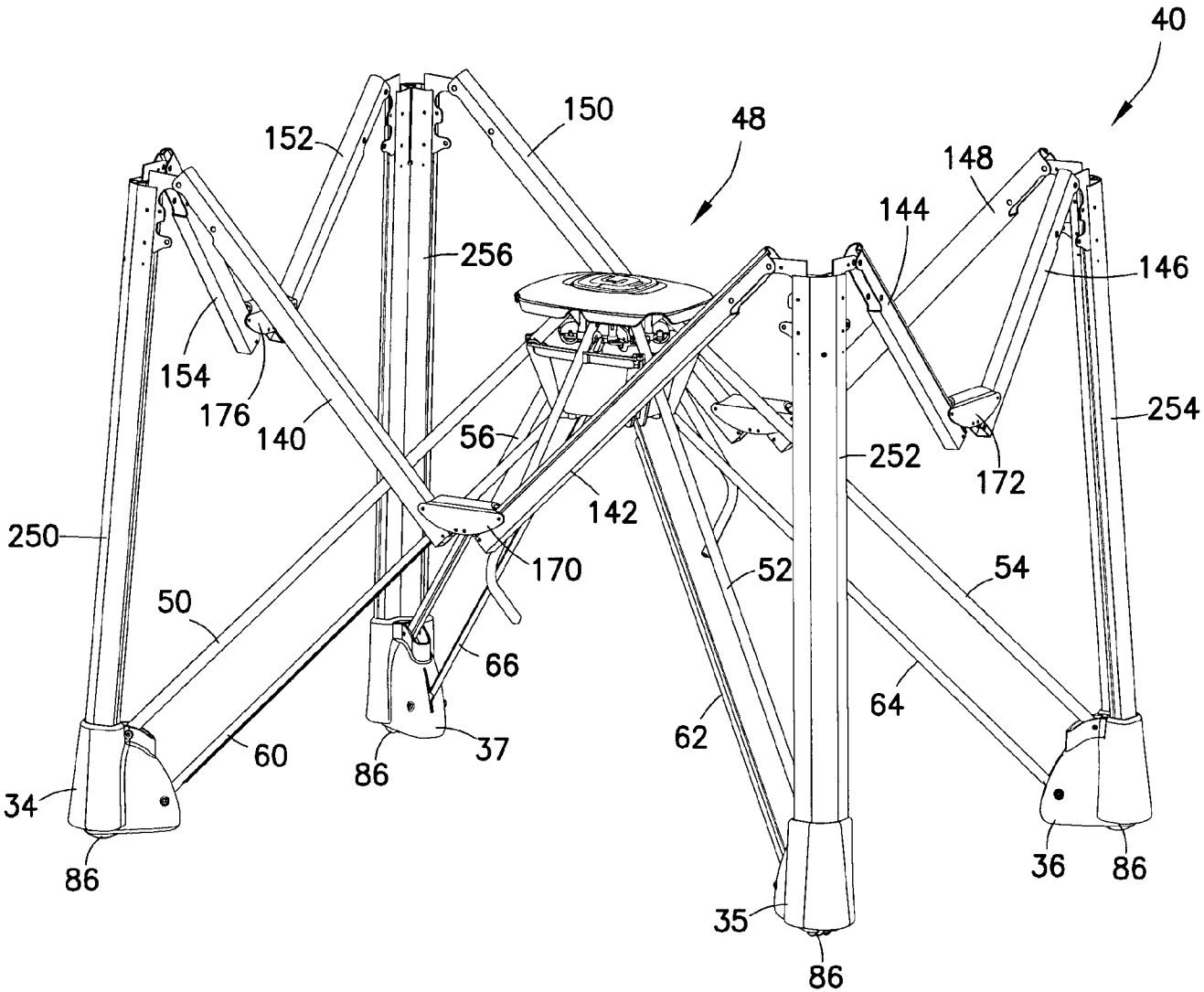
FIG. 15 is a perspective view of the frame as it moves toward an opened position.

Referring now to FIG. 15, the frame 40 is shown in a partially opened position when the hub assembly 48 has started to be pushed down. The base legs are rotated about 45° from a vertical reference line and upper arms have begun to move towards a horizontal configuration and are angled at about 5° below the horizontal plane. The upper housing 276 of the hub assembly 48, as shown in FIG. 12, is moved closer to the lower housing 278 by movement of the sleeve 298 within the mounting structure 296 of the lower housing 278, and the hub links have rotated the base legs downwardly. As shown in FIG. 16, the latching mechanism 200 has begun to force the upper arms (such as upper aim 140) toward a horizontal orientation based on the increased tension provided on cable 222 by the movement of camming plate 229 coupled to the upper base leg (such as upper base leg 50) in the direction of arrow A towards the plate 226. Accordingly, the downward rotation of the base legs helps the upper arms to rotate upwardly. The side posts (such as the side post 250) tilt outwardly but retain a relatively vertical orientation and the frame 40 remains very stable.

With reference to FIG. 3, continual movement of the hub assembly 48 in the downward direction moves the frame 40 into the full opened position. The hub assembly 48 is on the floor or nearly so; the sleeve 298 has moved further within the mounting structure 296 and is locked by rotation of the handle 280 by any suitable latching mechanism 200, and all of the base legs and upper arms are generally in horizontal positions. As the camming plate 229 comes into contact with the plate 226, it causes the plate 226 to rotate about its pivot point 228 and provide a tensioning force to the cable 222. Once the base legs reach a generally horizontal position, a maximum tension force is provided to the cable 222 as shown schematically in FIG. 11. This tensioning force is transferred to the latching mechanism 200 to move the latching mechanism 200 to the locked position shown in FIG. 9. When in this position, the latching mechanism 200 forces the upper arms (such as upper arm 140) to an angle that is above a horizontal plane. The stiffening members 170, 172, 174, 176, however, retain the upper arms in the horizontal plane as shown in FIG. 3, and the upper arms are locked in place. The frame 40 is very stable with the side posts leaning slightly inward as shown in FIG. 3. With reference to FIG. 18, each of the stiffening members 170, 172, 174, 176 may have a locking cam 500 as an additional safety measure to lock the stiffening members in place when frame 40 is deployed to a fully opened position. The locking cam 500 is locked by pushing downward on each stiffening member 170, 172, 174, 176 once frame 40 is fully opened such that locking cam 500 is advanced from an unlocked position to a locked position.

In progressing from the fully folded position to the fully opened position, the frame may be viewed as going through three phases. Initially, there is a "spreading" phase, followed by a "lift" phase, and then the last "locking" phase.

The sequence of movement from the opened position toward the folded position, will now be described. First, the handle 280 is rotated to unlock the sleeve 298 from the mounting structure 296 and the handle 280 is lifted. This causes the safety detent 400 to unlock the feet of the locking legs 404 and withdraw them within sleeve 298 to allow the handle to continue to move in the upward direction. The lifting of the handle 280 of the hub assembly 48, which may be accomplished with only one hand, rotates the base legs upwardly and relieves the tension in the cable 222 by slowly removing the contact of the camming plate 229 from the plate 226. The removal of this tension allows the locking member 214 of the latching mechanism 200 to begin to nest within the first leg 202, and the first leg 202 to begin to nest within the second leg 208. Continual movement of the hub assembly 48 upwardly causes the sleeve 298 to move within and away from the mounting structure 296, thereby causing the upper housing 276 to move upwardly and away from the lower housing 278. This causes the links to be lowered so that the base legs are pivoted downwardly. When the hub assembly 48 is fully raised above the floor as shown in FIG. 14, the frame is in the fully folded position.

When the frame is in the opened position, as shown in FIG. 3, the base legs and the upper arms are generally in horizontal positions, and the side posts are generally in vertical positions. When the frame is in the folded position for storage and/or transport, as shown in FIG. 14, the side posts remain in generally vertical positions, and the base legs and the upper arms are pivoted or rotated to more generally vertical positions. It is to be noted that the terms "generally horizontal" and "generally vertical" are meant to indicate approximation and that the referenced structures are at, or near, or about horizontal or vertical.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

The invention claimed is:

1. A foldable structure comprising:

an upper assembly forming an upper portion of the structure, the upper assembly comprising a plurality of arm assemblies;

a base assembly forming a lower portion of the structure;

a centrally-located hub assembly operatively connected to the base assembly;

a post extending from each corner of the upper assembly to a corner of the base assembly, thereby forming the structure; and at least one latching mechanism provided at each corner of the upper assembly extending from an upper portion of at least one of the posts to a portion of at least one of the arm assemblies, wherein movement of the hub assembly towards a surface upon which the foldable structure is positioned causes the foldable enclosure to move from a folded position to an opened position, and movement of the hub assembly away from the surface causes the foldable structure to move from the open position to the folded position, and wherein each latching mechanism comprises:

a first leg having a first end pivotally connected to and extending from the upper portion of one of the posts and a second end;

a second leg having a first end pivotally connected to the second end of the first leg and a second end connected to a portion of one of the arm assemblies of the upper assembly; and a locking member having a first end pivotally coupled to the upper portion of one of the posts between an end of the post and a position where the first end of the first leg is coupled to the upper portion of the post and a second end connected between the first leg and the second leg.

2. The foldable structure of claim 1, wherein the hub assembly is operatively connected to the at least one latching mechanism by an operating structure.

3. The foldable structure of claim 2, wherein movement of the hub assembly towards a surface upon which the foldable structure is positioned causes the operating structure to force the at least one latching mechanism into a locked position, and movement of the hub assembly away from the surface causes the operating structure to force the at least one latching mechanism into a released position.

4. The foldable structure of claim 2, wherein the operating structure is one or more cables.

5. The foldable structure of claim 2, wherein the posts are hollow and the operating structure extends from the hub assembly to the at least one latching mechanism through at least one of the posts.

6. The foldable structure of claim 1, wherein the base assembly comprises upper and lower base legs in an X-shaped configuration.

7. The foldable structure of claim 1, wherein the first leg and the second leg extend between the upper portion of one of the posts and the portion of one of the arm assemblies when the foldable structure is in the opened position, and the first leg is nested inside the second leg, and the first and second legs are positioned between the at least one post and the at least one arm assembly when the foldable structure is in the closed position.

8. The foldable structure of claim 1, wherein the locking member is positioned perpendicular to the first leg and the second leg when the foldable structure is in the opened position, and the locking member is nested within the first leg when the foldable structure is in the closed position.

9. A foldable structure, comprising:

an upper assembly having a plurality of upper arms;

a base assembly having a plurality of base legs;

a side structure having a plurality of side posts connecting the upper assembly to the base assembly; and a centrally-located hub assembly that causes the apparatus to move between a closed position and an open position, wherein the structure is prevented from moving from an opened position to a closed position by at least one latching mechanism provided at at least one corner of the upper assembly.

10. The foldable structure of claim 9, wherein each latching mechanism comprises:

a first leg having a first end pivotally connected to and extending from the upper portion of one of the side posts and a second end;

a second leg having a first end pivotally connected to the second end of the first leg and a second end pivotally connected to a portion of one of the upper arms of the upper assembly; and a locking member having a first end pivotally coupled to the upper portion of one of the side posts between an end of the side post and a position where the first end of the first leg is coupled to the upper portion of the side post and a second end connected between the first leg and the second leg.

11. The foldable structure of claim 10, wherein the plurality of base legs of the base assembly comprises upper and lower base legs in an X-shaped configuration.

12. The foldable structure of claim 10, wherein the first leg and the second leg extend between the upper portion of one of the posts and the portion of one of the arm assemblies when the foldable structure is in the opened position, and the first leg is nested inside the second leg, and the first and second legs are positioned between the at least one side post and the at least one upper arm when the foldable structure is in the closed position.

13. The foldable structure of claim 10, wherein the locking member is positioned perpendicular to the first leg and the second leg when the foldable structure is in the opened position, and the locking member is nested within the first leg when the foldable structure is in the closed position.

14. The foldable structure of claim 10, wherein the hub assembly is operatively connected to the at least one latching mechanism by an operating structure.

15. The foldable structure of claim 14, wherein the operating structure is one or more cables.

16. A foldable structure comprising:

an enclosure defining a space within;

a hub assembly centrally located at a bottom of the structure; and a latching mechanism operatively coupled to the hub assembly and provided at at least one corner of the structure, the latching mechanism comprising:

a first leg having a first end pivotally connected to and extending from an upper portion of a vertical post of the structure and a second end; and a second leg having a first end pivotally connected to the second end of the first leg and a second end pivotally connected to a portion of an arm assembly of an upper assembly of the structure, wherein the hub assembly is movable in a linear vertical direction such that movement of the hub assembly causes at least one of engagement or disengagement of the latching mechanism.

17. The foldable structure of claim 16, wherein the first leg and the second leg extend between the upper portion of the vertical post and the portion of the arm assembly when the foldable structure is in an open position, and the first leg is nested inside the second leg, and the first and second legs are positioned between the vertical post and the arm assembly when the foldable structure is in a closed position.

18. The foldable structure of claim 16, wherein the latching mechanism further comprises a locking member having a first end pivotally coupled to the upper portion of the vertical post between an end of the vertical post and a position where the first end of the first leg is coupled to the upper portion of the vertical post and a second end connected between the first leg and the second leg.

19. The foldable structure of claim 18, wherein the locking member is positioned perpendicular to the first leg and the second leg when the foldable structure is in the opened position, and the locking member is nested within the first leg when the foldable structure is in the closed position.

* * * * *